US008744310B2

(12) United States Patent
Mitsui et al.

(10) Patent No.: US 8,744,310 B2
(45) Date of Patent: Jun. 3, 2014

(54) DETACHABLE UNIT AND IMAGE FORMING APPARATUS

(75) Inventors: Taro Mitsui, Kanagawa (JP); Hirohisa Hoshino, Kanagawa (JP); Tatsuya Soga, Kanagawa (JP); Ryouta Kubo, Kanagawa (JP); Tomoya Ichikawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 281 days.

(21) Appl. No.: 13/116,805

(22) Filed: May 26, 2011

(65) Prior Publication Data

US 2012/0114372 A1 May 10, 2012

(30) Foreign Application Priority Data

Nov. 10, 2010 (JP) ..... 2010-252367

(51) Int. Cl.
*G03G 15/00* (2006.01)

(52) U.S. Cl.
USPC ..... 399/117

(58) Field of Classification Search
USPC ..... 399/110, 116, 117
See application file for complete search history.

(56) References Cited

U.S. PATENT DOCUMENTS 6,175,705 B1 1/2001 Harada et al.
2007/0036584 A1 * 2/2007 Kimura et al. ..... 399/116

FOREIGN PATENT DOCUMENTS

JP 2001-117308 A 4/2001

* cited by examiner

*Primary Examiner* — Walter L Lindsay, Jr.
*Assistant Examiner* — Barnabas Fekete
(74) *Attorney, Agent, or Firm* — Sughrue Mion, PLLC

(57) ABSTRACT

A detachable unit to be attached to a unit-receiving apparatus includes a unit body, a rotary member, an urging member urging the rotary member toward a downstream side in a detachable-unit-attaching direction, a contact-receiving portion provided on the rotary member, first and second support-receiving portions provided at respective ends of the rotary member, first and second supports provided at respective positions of the unit body corresponding to the positions of the first and second support-receiving portions, and first and second rotary support members provided between the first support-receiving portion and the first support and between the second support-receiving portion and the second support, respectively, and supporting the respective ends of the rotary member such that the rotary member is rotatable. The first and second rotary support members are supported in such a manner as to be movable in a detachable-unit-attaching-and-detaching direction.

6 Claims, 6 Drawing Sheets

DETACHABLE UNIT AND IMAGE FORMING APPARATUS

CROSS-REFERENCE TO RELATED APPLICATIONS

This application is based on and claims priority under 35 USC 119 from Japanese Patent Application No. 2010-252367 filed Nov. 10, 2010.

BACKGROUND (i) Technical Field

The present invention relates to a detachable unit and an image forming apparatus.

(ii) Related Art

Some related-art image forming apparatuses include elements provided in the form of detachable units that are detachable therefrom so that the elements are replaceable if, for example, the elements are damaged or are worn out with time or the elements fail.

SUMMARY

According to an aspect of the invention, there is provided a detachable unit to be attached to a unit-receiving apparatus. The detachable unit includes a unit body; a rotary member supported by the unit body and to which rotation of a rotary shaft provided on the unit-receiving apparatus is transmitted in a state where the rotary shaft has been inserted into the rotary member, the rotary shaft extending in an attaching and detaching direction in which the detachable unit is attached to and detached from the unit-receiving apparatus; an urging member urging the rotary member toward a downstream side in an attaching direction in which the detachable unit is attached to the unit-receiving apparatus; a contact-receiving portion provided at a position of the rotary member on the downstream side in the attaching direction and being configured to be pressed against a contact portion provided on the rotary shaft toward an upstream side in the attaching direction when the detachable unit is attached to the unit-receiving apparatus; a first support-receiving portion provided at one end of the rotary member; a second support-receiving portion provided at the other end of the rotary member; a first support provided at a position of the unit body corresponding to the position of the first support-receiving portion; a second support provided at a position of the unit body corresponding to the position of the second support-receiving portion; a first rotary support member provided between the first support-receiving portion and the first support and supporting the one end of the rotary member such that the rotary member is rotatable, the first rotary support member being supported in such a manner as to be movable in the attaching and detaching direction relative to at least one of the first support-receiving portion and the first support; and a second rotary support member provided between the second support-receiving portion and the second support and supporting the other end of the rotary member such that the rotary member is rotatable, the second rotary support member being supported in such a manner as to be movable in the attaching and detaching direction relative to at least one of the second support-receiving portion and the second support.

BRIEF DESCRIPTION OF THE DRAWINGS

An exemplary embodiment of the present invention will be described in detail based on the following figures, wherein.

DETAILED DESCRIPTION

Figure 1:
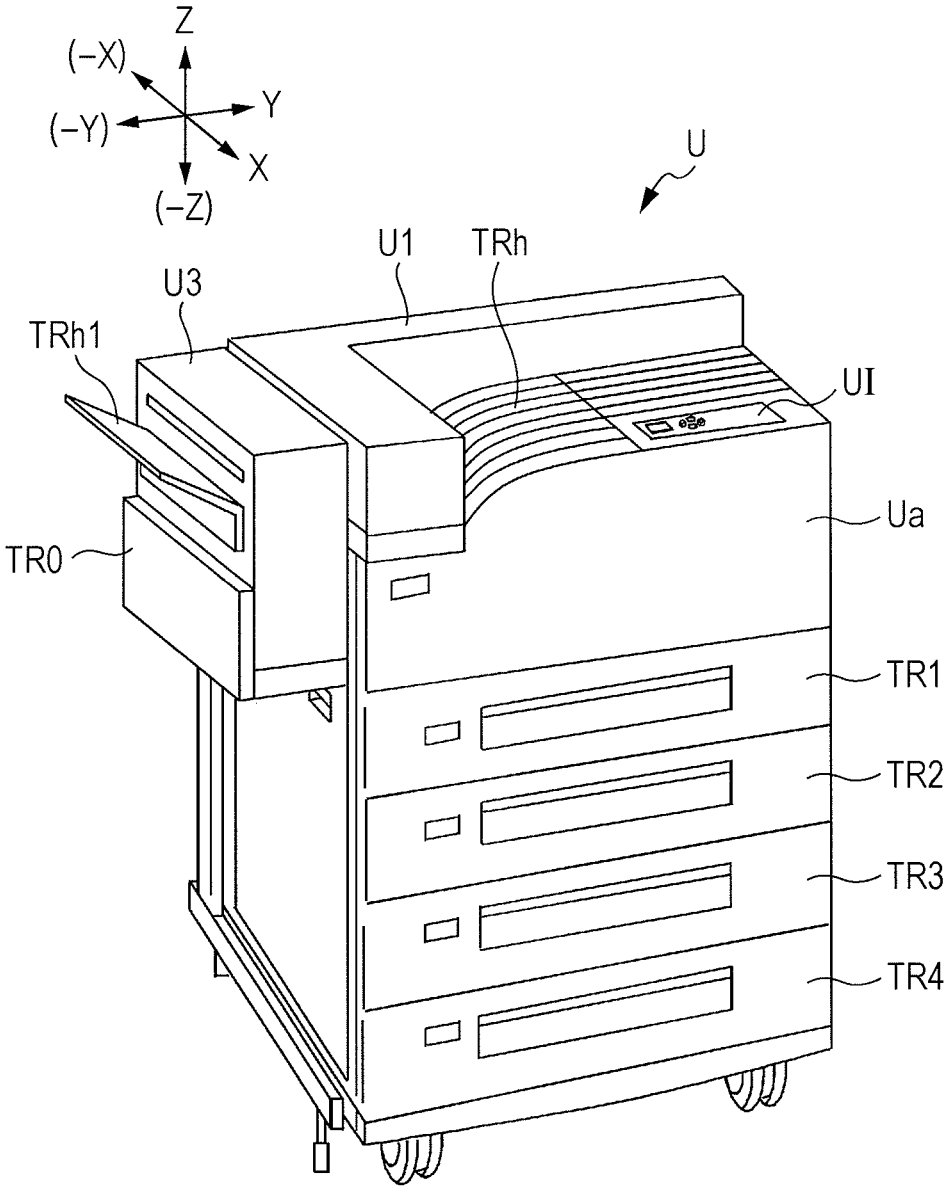
FIG. 1 is a perspective view of an image forming apparatus according to an exemplary embodiment of the invention.

An exemplary embodiment of the present invention will now be described with reference to the accompanying drawings. Note that the invention is not limited to the following exemplary embodiment.

For easier understanding of the following description, directions in the drawings are defined as follows: the antero-posterior direction is defined as the X-axis direction, the lateral direction is defined as the Y-axis direction, and the vertical direction is defined as the Z-axis direction. Furthermore, arrows X, −X, Y, −Y, Z, and −Z indicate the directions toward the front, the rear, the right, the left, the top, and the bottom, respectively.

Furthermore, in the drawings, the encircled dot represents an arrow extending from the back side toward the front side of the page, and the encircled cross represents an arrow extending from the front side toward the back side of the page.

In the following description and the drawings referred to therein, descriptions and illustrations of irrelevant elements are omitted for easier understanding.

Exemplary Embodiment

FIG. 1 is a perspective view of an image forming apparatus according to an exemplary embodiment of the invention.

Figure 2:
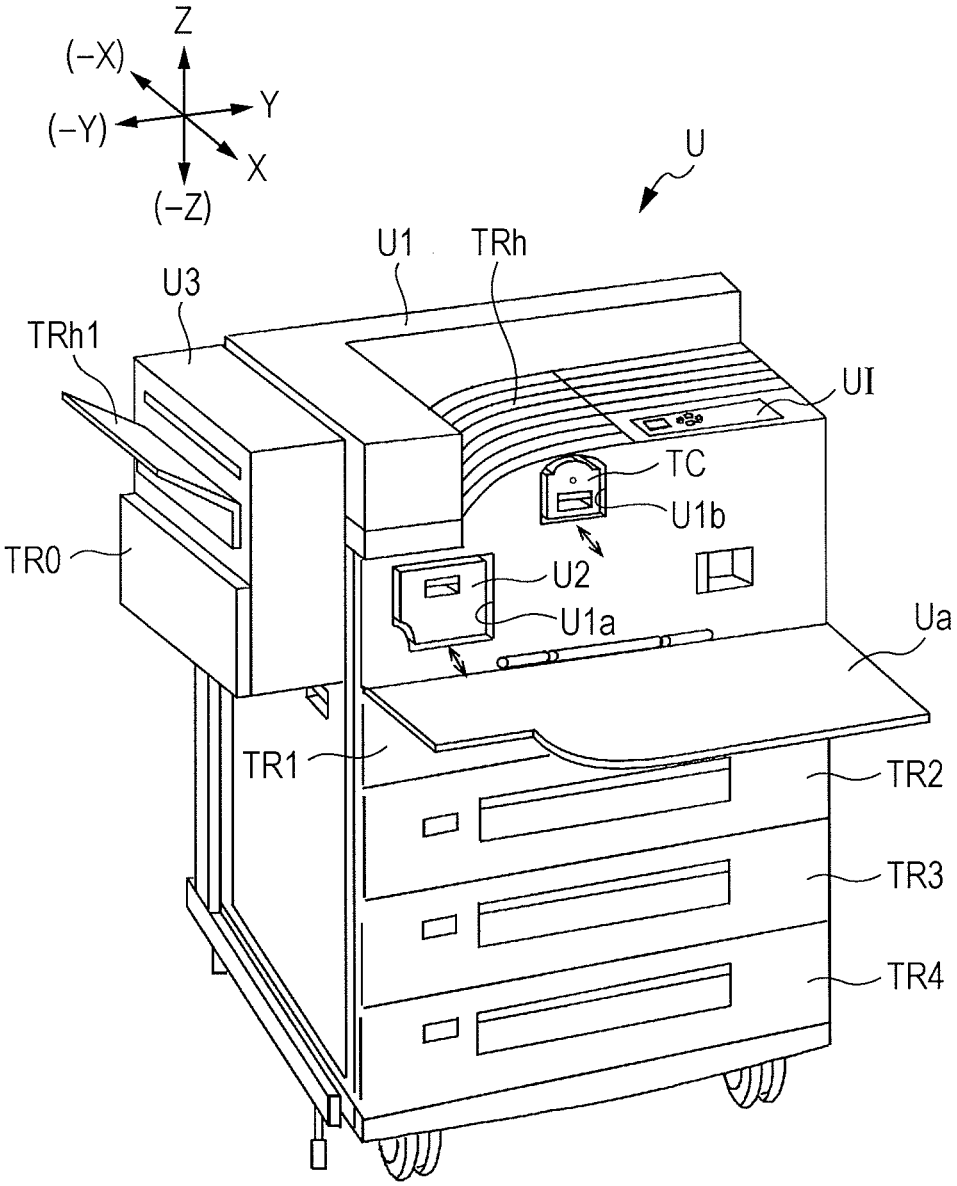
FIG. 2 illustrates the image forming apparatus illustrated in FIG. 1 with an openable/closable portion thereof being at an open position.

FIG. 2 illustrates the image forming apparatus illustrated in FIG. 1 with an openable/closable portion thereof being at an open position.

Referring to FIG. 1, a printer U (an exemplary image forming apparatus according to the exemplary embodiment) includes a printer body U1 (an exemplary image-forming-apparatus body or an exemplary unit-receiving apparatus). The printer body U1 has at the top thereof a first output tray TRh (an exemplary first medium-output portion), which is a facedown tray, and an operation portion UI on which the user performs input operations. The operation portion UI is provided on the front side and near the leading end of the first output tray TRh in a medium output direction. The operation portion U1 includes a display and so forth. The printer body U1 has on the upper front face thereof a front panel Ua (an exemplary openable/closable portion). The front panel Ua is supported at the lower end thereof by the printer body U1 in such a manner as to be rotatable about a shaft extending in the lateral direction. Referring to FIG. 2, the printer body U1 has a process-unit-housing portion U1*a* and a toner-cartridge-housing portion U1*b* (exemplary unit-housing portions). By moving the front panel Ua from a closed position illustrated in FIG. 1 to the open position illustrated in FIG. 2, a toner cartridge TC (an exemplary developer container) and a process unit U2 (an exemplary detachable unit) are ready to be replaced.

Figure 3:
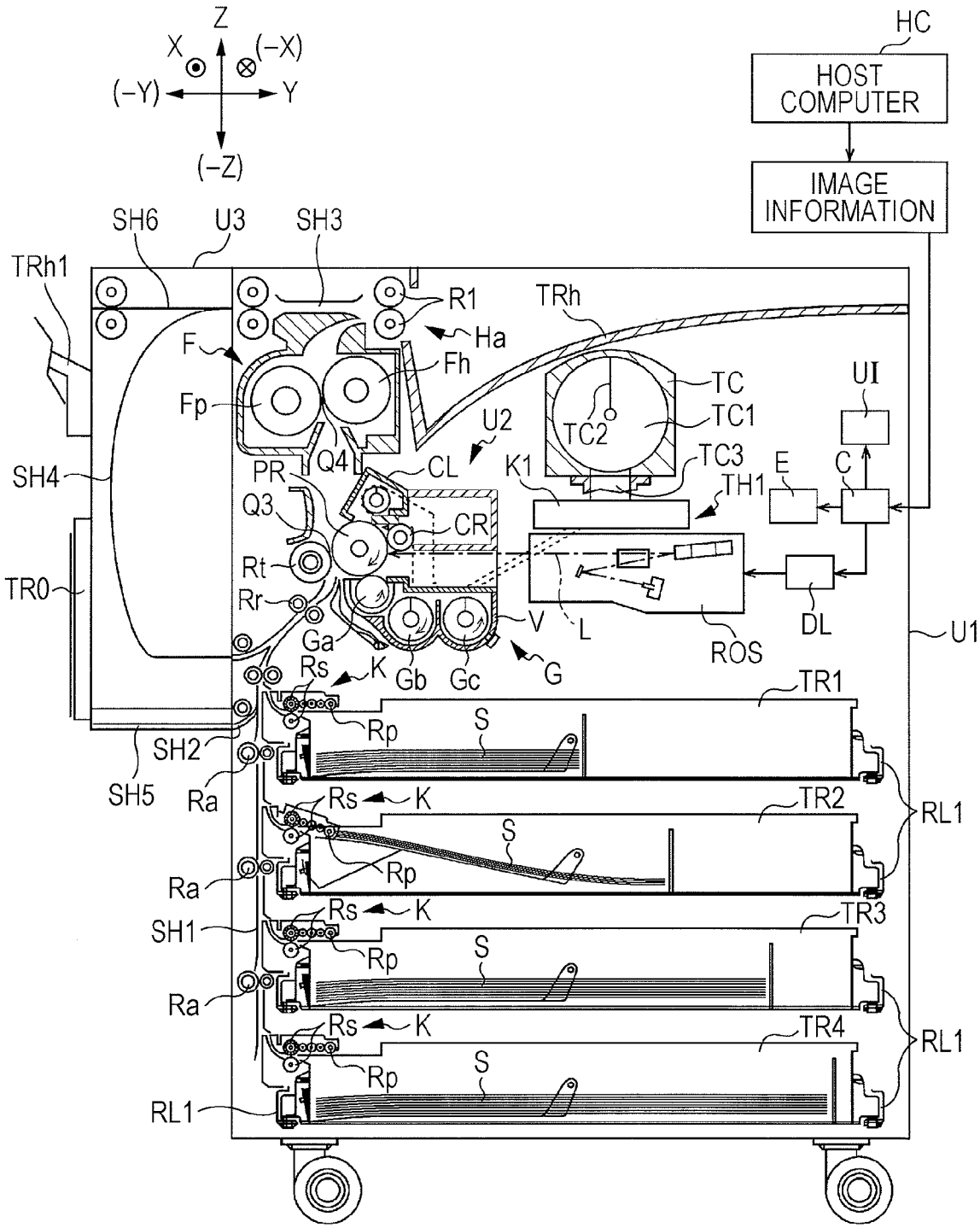
FIG. 3 illustrates the overall configuration of the image forming apparatus according to the exemplary embodiment.

FIG. 3 illustrates the overall configuration of the image forming apparatus, i.e., the printer U, according to the exemplary embodiment.

Referring to FIG. 3, the printer U is electrically connected to a host computer HC (an exemplary image-information-transmitting apparatus). Image information and electrical signals such as a control signal transmitted from the host computer HC are input to a controller C (an exemplary control unit) of the printer U. The controller C temporarily stores the image information that is input thereto, converts the image information into information for latent image formation with a preset timing, and outputs the converted information to a laser drive circuit DL (an exemplary latent-image-forming circuit).

The laser drive circuit DL outputs a drive signal corresponding to the information that is input thereto to a latent-image-forming device ROS. The controller C controls the operation portion UI, the laser drive circuit DL, a power circuit E that applies voltages to a developing roller Ga and to a transfer roller Rt described separately below, and other elements.

Figure 4:
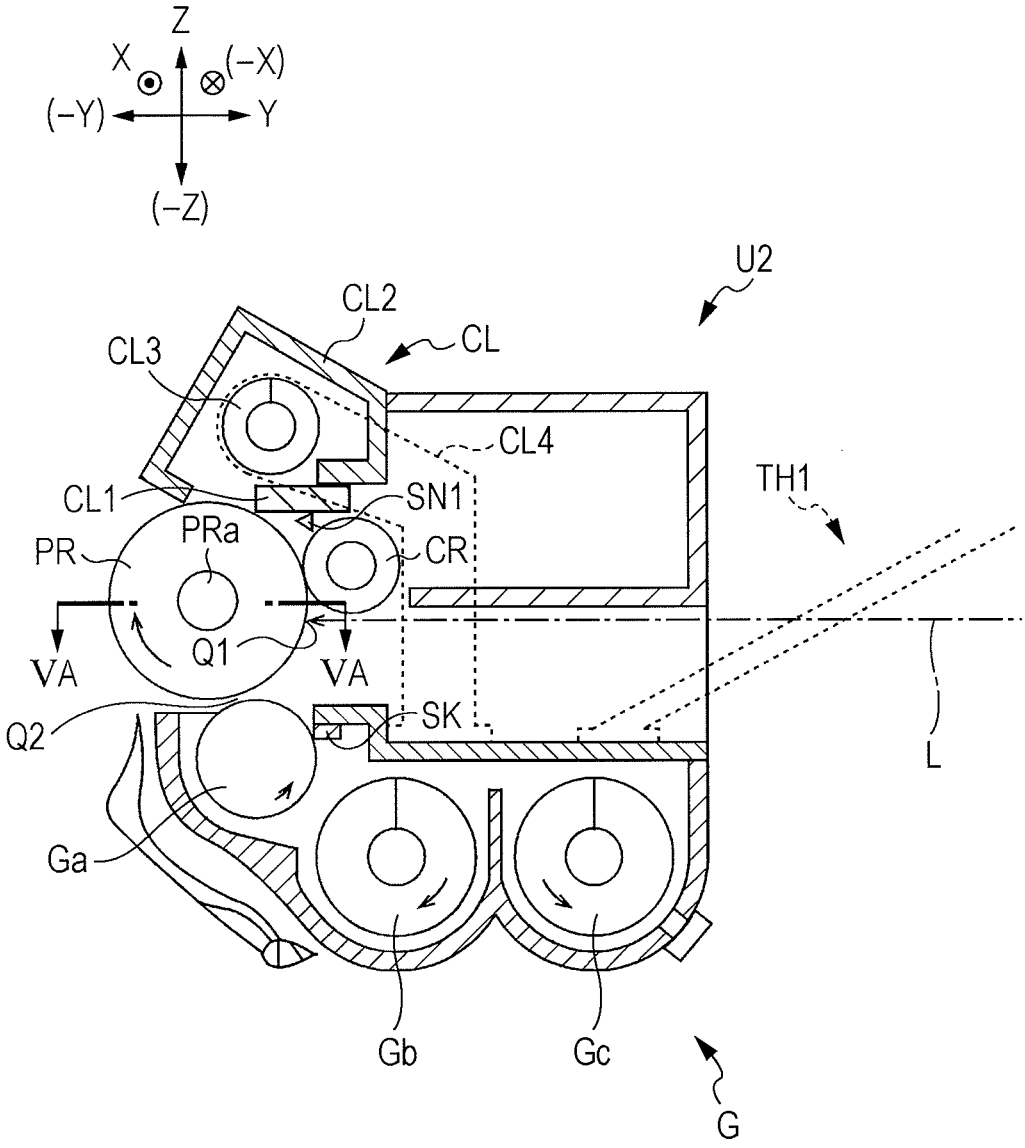
FIG. 4 is an enlarged view of a toner-image-forming device included in the image forming apparatus illustrated in FIG. 3.

FIG. 4 is an enlarged view of the process unit U2, also referred to as toner-image-forming device, illustrated in FIG. 3.

Referring to FIGS. 3 and 4, the toner-image-forming device U2 (an exemplary visible-image-forming device) forms a black-colored toner image. The toner-image-forming device U2 is provided on the left side of the latent-image-forming device ROS. A laser beam L (exemplary latent-image-forming light) is emitted from the latent-image-forming device ROS and strikes a photoconductor PR that is rotating.

Referring to FIGS. 3 and 4, the toner-image-forming device U2 according to the exemplary embodiment includes the photoconductor PR (an exemplary image-bearing member). The photoconductor PR rotates about a shaft PRa in a direction indicated by the arrow. A charging roller CR (an exemplary charging member), a developing device G, and a photoconductor cleaner CL (an exemplary image-bearing-member cleaner) are provided around the photoconductor PR in that order in the direction of rotation of the photoconductor PR. The toner-image-forming device U2 is provided in the form of a unit, i.e., the process unit U2, and is detachably attached in the printer body U1. As illustrated in FIG. 2, the attaching and detaching of the process unit U2 is performed in the state where the front panel Ua openably/closably supported on the front face of the printer body U1 is opened.

Referring to FIGS. 3 and 4, the surface of the photoconductor PR is charged by the charging roller CR to which a charging voltage is applied. Subsequently, at a latent-image-drawing position Q1, the charged surface of the photoconductor PR is subjected to scan exposure with the laser beam L emitted from the latent-image-forming device ROS. Thus, an electrostatic latent image is formed on the photoconductor PR. As the photoconductor PR having the electrostatic latent image rotates, the electrostatic latent image sequentially passes through a development area Q2 and a transfer area Q3.

The developing device G includes a developing-device case V in which toner (exemplary developer) is stored. The developing roller Ga (an exemplary developer-bearing member) is rotatably supported in the developing-device case V. The developing roller Ga faces the photoconductor PR in the development area Q2. A developing voltage is applied to the developing roller Ga. Furthermore, toner-stirring members Gb and Gc are rotatably supported in the developing-device case V. The toner-stirring members Gb and Gc stir and transport the toner to the developing roller Ga. Thus, with the rotation of the developing roller Ga, the toner borne by the developing roller Ga is transported to the development area Q2, and the electrostatic latent image on the photoconductor PR that passes through the development area Q2 is developed into a toner image (an exemplary visible image).

The developing-device case V is connected at the front end thereof to one end of a supply path of a cartridge-toner-supplying device TH1 (an exemplary developer-supplying device) that is secured to the printer body U1. The other end of the supply path of the cartridge-toner-supplying device TH1 is connected to an ejection port TC3 of the toner cartridge TC (an exemplary developer container).

Referring to FIG. 3, the toner cartridge TC includes a cartridge body TC1 (an exemplary container body) that contains toner. The cartridge body TC1 supports thereinside a toner-transporting member TC2 (an exemplary in-container transporting member) such that the toner-transporting member TC2 is rotatable. Thus, with the consumption of the toner by the developing device G, the toner-transporting member TC2 is driven to rotate in such a manner as to transport the toner in the cartridge body TC1 to the ejection port TC3. The toner ejected from the ejection port TC3 is transported to the developing-device case V of the developing device G by a supply-path transporting member (not illustrated) provided in the supply path of the cartridge-toner-supplying device TH1.

The toner cartridge TC is attachable and detachable by being inserted into and withdrawn from the printer body U1 in the anteroposterior direction. The toner cartridge TC is attached and detached with the front panel Ua being opened as illustrated in FIG. 2. The front panel Ua is openably/closably supported on the front face of the printer body U1.

The photoconductor PR, the charging roller CR, the developing device G, and other elements in combination function as the toner-image-forming device U2 that forms a toner image on the photoconductor PR.

Referring to FIGS. 1 and 3, the printer U includes at the bottom thereof plural sheet trays TR1 to TR4 (exemplary medium containers). The sheet trays TR1 to TR4 contain recording sheets S (exemplary media) to be transported to the transfer area Q3.

Referring to FIG. 3, the printer U also includes on the bottom inside thereof rails RL1 (exemplary container-guiding members) that support the right and left ends of the sheet trays TR1 to TR4, which are insertable into and withdrawable from the printer body U1, such that the sheet trays TR1 to TR4 are movable. Specifically, the sheet trays TR1 to TR4 are each supported by a pair of right and left rails RL1 in such a manner as to be movable in the anteroposterior direction. Thus, the sheet trays TR1 to TR4 are insertable and withdrawable from the front face of the printer U.

Referring to FIG. 3, sheet-feeding devices K are provided above and on a feed side of the sheet trays TR1 to TR4, respectively. The sheet-feeding devices K each include a pickup roller Rp (an exemplary medium pickup member) and a separating roller group Rs (an exemplary separating member). The separating roller group Rs includes a feed roller (an exemplary medium-transporting member) and a retard roller (an exemplary medium-separating member).

Some recording sheets S are picked up by the pickup roller Rp of one of the sheet-feeding devices K and are separated one by one by the separating roller group Rs. Each of the separated sheets S is fed into a printer-body transport path SH1. The sheet S fed into the printer-body transport path SH1 is transported by sheet-transporting rollers Ra (exemplary plural transporting members) provided in the printer-body transport path SH1. The sheet S transported by the sheet-transporting rollers Ra is further transported to the transfer area Q3 by a registration roller Rr (an exemplary timing-adjusting member) with the timing that the toner image on the photoconductor PR reaches the transfer area Q3.

The printer U includes on the left side thereof a manual feed tray TR0 (an exemplary manual feeding portion). A sheet S fed from the manual feed tray TR0 advances from an additional manual-feed transport path SH5 and then into a manual-feed transport path SH2, and is transported to the transfer area Q3 by the sheet-transporting rollers Ra provided in the printer-body transport path SH1 and by the registration roller Rr.

Referring to FIG. 3, the transfer roller Rt (an exemplary transfer device) is provided in the transfer area Q3. A transfer voltage is applied to the transfer roller Rt. In the transfer area Q3, the transfer roller Rt is in press-contact with the photoconductor PR at a preset pressure and transfers the toner image on the photoconductor PR to the sheet S transported through the transfer area Q3.

Referring to FIG. 4, after the toner image on the photoconductor PR is transferred to the sheet S in the transfer area Q3, residual toner (exemplary residual developer) adhering to the surface of the photoconductor PR is removed by a cleaning blade CL1 (an exemplary cleaning member) included in the photoconductor cleaner CL and is collected into the photoconductor cleaner CL. Thus, the photoconductor PR is cleaned. The residual toner removed by the cleaning blade CL1 is received by a cleaner case CL2 (an exemplary cleaner container). The toner in the cleaner case CL2 is transported toward the front by a collecting auger CL3 (an exemplary collecting/transporting member) and is returned into the developing-device case V through a collecting path CL4 provided at the front end of the cleaner case CL2, so that the toner is reused.

The photoconductor PR from which the residual toner has been removed by the photoconductor cleaner CL is charged by the charging roller CR again. In the exemplary embodiment, the charging roller CR is equipped with a temperature sensor SN1 (an exemplary temperature-detecting member) that detects the temperature of the charging roller CR.

The sheet S having the toner image, which is yet to be fixed, transferred thereto in the transfer area Q3 is transported to a fixing area Q4 defined in a fixing device F. The fixing device F includes a heating roller Fh (an exemplary thermal-fixing member) and a pressure roller Fp (an exemplary pressure-fixing member). The heating roller Fh and the pressure roller Fp are in contact with each other in the fixing area Q4, in which the toner image is thermally fixed.

The toner-image-forming device U2, the transfer roller Rt, and the fixing device F in combination function as an image-recording section U2+Rt+F that records an image on the sheet S.

The sheet S having the fixed toner image is guided to sheet output rollers R1 (exemplary output members) by a sheet guide (an exemplary medium-guiding member), and is output to the first output tray TRh through a sheet output port Ha (an exemplary medium output port) by the sheet output rollers R1.

In the printer U, a printer-body reversing path SH3 communicating with the sheet output port Ha is provided above the fixing device F. A sheet-reversing device U3 (an exemplary medium-reversing device) is provided above the manual feed tray TR0. The sheet-reversing device U3 is an additional device. An optional reversing path SH4 (an exemplary additional reversing path) communicating with the printer-body reversing path SH3 is provided in the sheet-reversing device U3. Hence, in duplex printing, the sheet S having the toner image fixed thereon in the fixing area Q4 advances through the printer-body reversing path SH3 and the optional reversing path SH4 to the registration roller Rr, and is transported to the transfer area Q3 again.

The printer-body reversing path SH3 and the optional reversing path SH4 in combination function as a reversing path SH3+SH4.

The sheet-reversing device U3 also includes an optional output tray TRh1 (an exemplary additional medium output portion), which is a faceup tray. The sheet S is output to the optional output tray TRh1 with the side thereof having the recorded image positioned face up. An optional output path SH6 (an exemplary additional output path) is provided between the optional output tray TRh1 and the printer-body reversing path SH3. When it is set by the user that the sheet S is to be output to the optional output tray TRh1, the sheet S advances from the printer-body reversing path SH3 through the optional output path SH6, and is output to the optional output tray TRh1.

(Description of Photoconductor Drive Shaft and Process Unit)

Figure 5A:
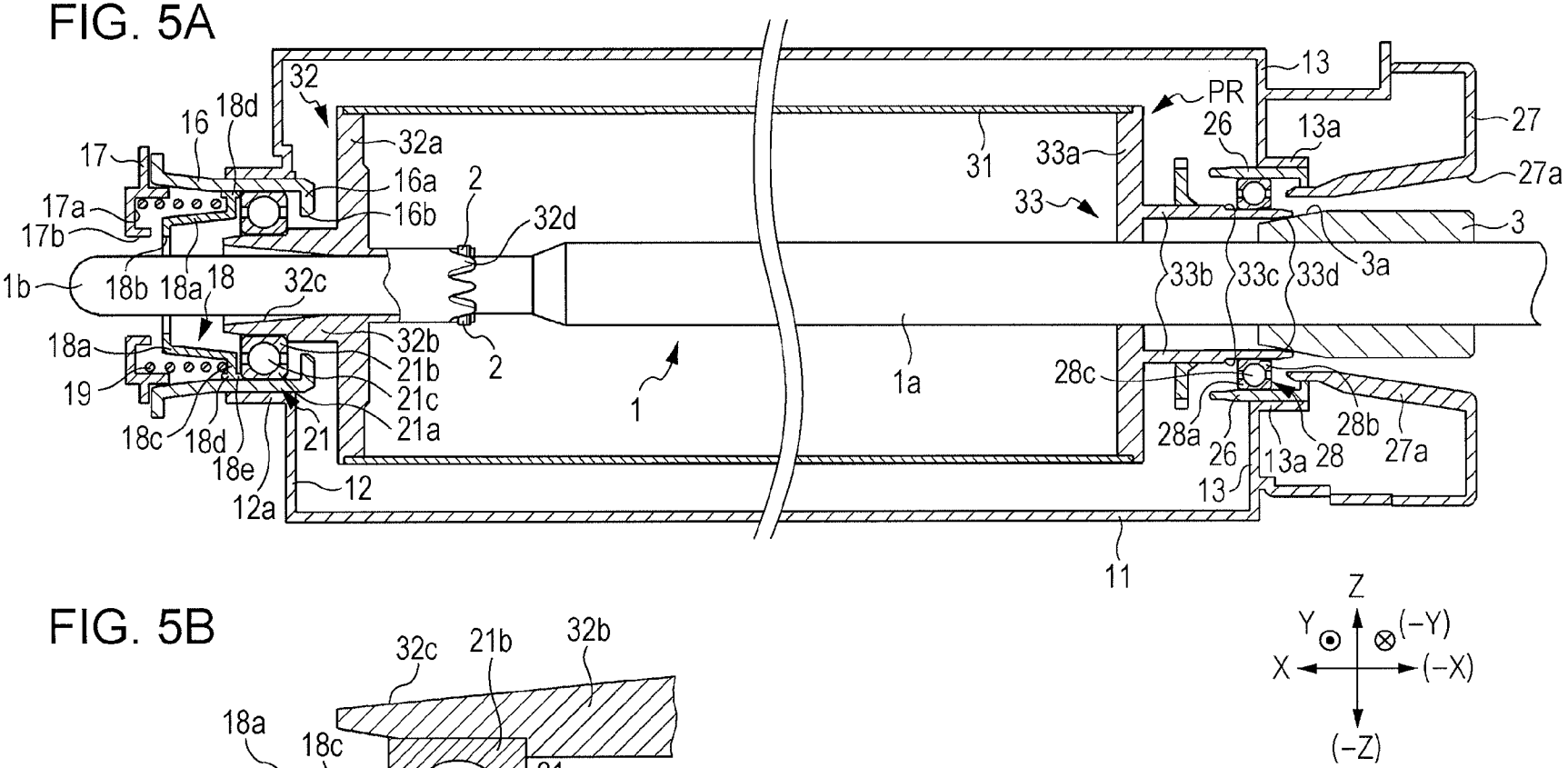
FIG. 5A is a cross-sectional view of a photoconductor and other elements included in the toner-image-forming device according to the exemplary embodiment taken along line VA-VA of FIG. 4.
Figure 5B:
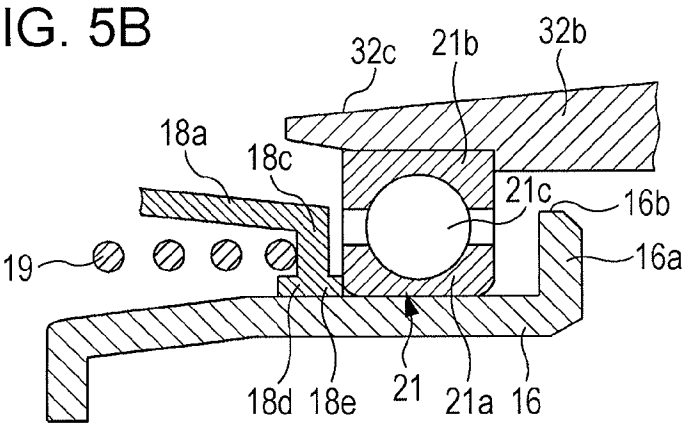
FIG. 5B is an enlarged cross-sectional view of a front bearing and other elements illustrated in FIG. 5A.

FIGS. 5A and 5B are cross-sectional views of the photoconductor PR and other elements included in the process unit U2 according to the exemplary embodiment. FIG. 5A is taken along line VA-VA of FIG. 4. FIG. 5B is an enlarged view of a front bearing 21 and other elements.

Figure 6:
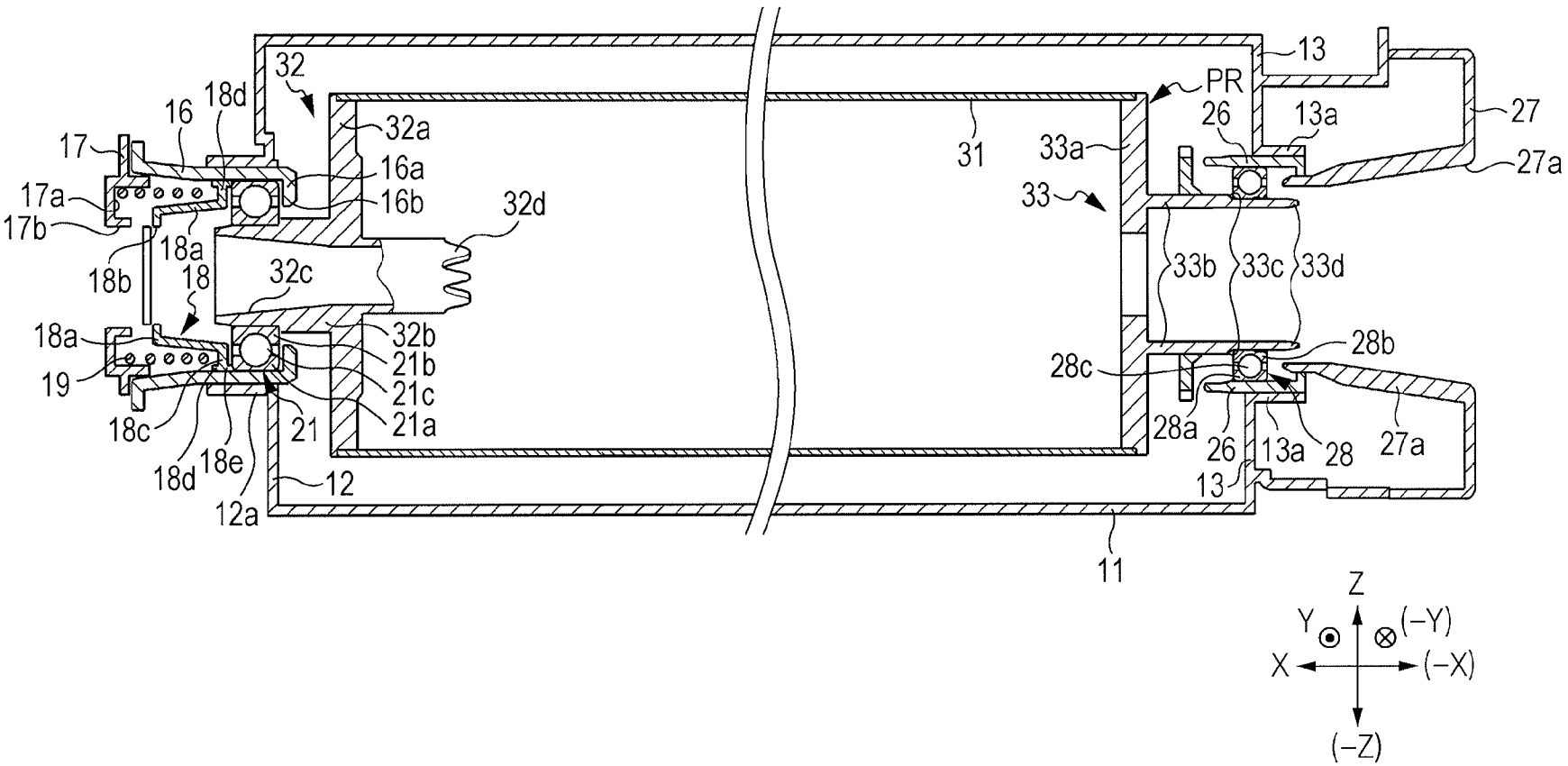
FIG. 6 illustrates the toner-image-forming device illustrated in FIG. 5A that has been detached from an image-forming-apparatus body.

FIG. 6 illustrates the process unit U2 illustrated in FIG. 5A that has been detached from the printer body U1.

Referring to FIGS. 5A, 5B, and 6, the printer body U1 of the printer U according to the exemplary embodiment supports a drive shaft 1 (an exemplary rotary shaft). The drive shaft 1 extends in the anteroposterior direction (an exemplary attaching and detaching direction) in which the process unit U2 is attached to and detached from the printer body U1. A driving force is transmitted to the drive shaft 1 from a motor (an exemplary drive source, not illustrated). The drive shaft 1 has a round columnar shape extending in the anteroposterior direction and includes a small-diameter portion 1*b* at the front end thereof and a large-diameter portion 1*a* extending from the middle to the rear end thereof and having a larger diameter than the small-diameter portion 1*b*. The small-diameter portion 1*b* supports a transmitting pin 2 (an exemplary rotation-transmitting member). The transmitting pin 2 extends through the small-diameter portion 1*b* in such a manner as to project radially outward. The length of the transmitting pin 2 in the radial direction is set so as to be smaller than the diameter of the large-diameter portion 1*a*.

The large-diameter portion 1*a* is provided with a cylindrical tapered member 3 (an exemplary contact portion) that is secured to the rear end of the large-diameter portion 1*a*. The diameter of the tapered member 3 is reduced toward the front such that the front end of the tapered member 3 has a conical shape with the outer surface thereof forming a contact surface 3*a*.

Referring to FIGS. 5A, 5B, and 6, the process unit U2 includes a unit frame 11 (an exemplary unit body). The unit frame 11 includes a disc-shaped front frame 12 (an exemplary body front portion) provided on the front side and a disc-shaped rear frame 13 (an exemplary body rear portion) provided on the rear side.

The front frame 12 includes at the inner periphery thereof a front cylindrical portion 12*a* extending toward the front. The rear frame 13 includes at the inner periphery thereof a rear cylindrical portion 13*a* extending toward the rear.

The front cylindrical portion 12*a* secures at the inner periphery thereof a cylindrical front sleeve 16 (an exemplary first support). The front sleeve 16 includes at the rear end thereof a disc-shaped front stopper 16*a* (an exemplary first stopping portion) projecting radially inward. The inner periphery of the front stopper 16*a* defines a through hole 16*b* having a larger diameter than the drive shaft 1. The through hole 16*b* allows the drive shaft 1 to pass therethrough with a sufficient gap provided around the drive shaft 1.

The front sleeve 16 supports at the front end thereof a disc-shaped spring support 17 (an exemplary first urging-member support) that extends radially inward. The spring support 17 has a spring-supporting recess 17*a* (an exemplary first urging-member-supporting portion) that is concave toward the front. The inner periphery of the spring-supporting recess 17*a* defines a through hole 17*b* that allows the drive shaft 1 to pass therethrough.

A slidable cylinder 18 (an exemplary second urging-member support) is provided on the rear side with respect to the spring support 17. The slidable cylinder 18 includes a conical slidable body 18*a* whose diameter increases toward the rear. The slidable body 18*a* has at the front end thereof a through hole 18*b* that allows the drive shaft 1 to pass therethrough. The slidable body 18*a* is integrally provided with a hollow-disc-shaped spring-supporting portion 18*c* at the rear end thereof. The spring-supporting portion 18*c* (an exemplary second urging-member-supporting portion) extends radially outward. The spring-supporting portion 18*c* is integrally provided with a cylindrical guided portion 18*d* on the outer periphery thereof. The cylindrical guided portion 18*d* (an exemplary guided portion) extends in the anteroposterior direction. The outer peripheral surface of the cylindrical guided portion 18*d* is in contact with the inner peripheral surface of the front sleeve 16. Thus, the slidable cylinder 18 is supported in such a manner as to be movable in the anteroposterior direction by being guided along the inner peripheral surface of the front sleeve 16. The rear end of the cylindrical guided portion 18*d* forms a bearing contact portion 18*e* (an exemplary contact portion) that is in contact with the front bearing 21.

A coil spring 19 (an exemplary urging member) is supported between the spring-supporting portion 18*c* and the spring-supporting recess 17*a*. The coil spring 19 urges the slidable cylinder 18 toward the rear.

The front bearing 21 (an exemplary first rotary support member) is provided between the slidable cylinder 18 and the front stopper 16*a* of the front sleeve 16. The front bearing 21 according to the exemplary embodiment is a related-art ball bearing and includes an annular outer race 21*a* (an exemplary outer ring) provided on the radially outer side, an annular inner race 21*b* (an exemplary inner ring) provided on the radially inner side, and balls 21*c* (exemplary rolling members) provided between the outer race 21*a* and the inner race 21*b*. The outer race 21*a* and the inner race 21*b* are supported by the balls 21*c* in such a manner as to be rotatable relative to each other.

The outer race 21*a* according to the exemplary embodiment is supported by the inner peripheral surface of the front sleeve 16 in such a manner as to be movable in the anteroposterior direction. That is, the front bearing 21 according to the exemplary embodiment is supported by the front sleeve 16 in such a manner as to be slidable in the anteroposterior direction. The front end of the outer race 21*a* is in contact with the bearing contact portion 18*e* of the slidable cylinder 18 that is urged toward the rear by the coil spring 19. Thus, the front bearing 21 is urged toward the rear by the coil spring 19.

The rear cylindrical portion 13*a* secures at the inner periphery thereof a cylindrical rear sleeve 26 (an exemplary second support). The rear sleeve 26 supports at the rear end thereof a rear end cover 27 (an exemplary shaft-guiding member) provided at the rear end of the process unit U2. The inside diameter of the rear end cover 27 is reduced toward the front such that the inner peripheral portion thereof has a conical shape and forms a guide surface 27*a* along which the drive shaft 1 is guided when the process unit U2 is attached to the printer body U1.

A rear bearing 28 (an exemplary second rotary support member) is provided on the front inner periphery of the rear sleeve 26. The rear bearing 28 according to the exemplary embodiment is a related-art ball bearing, as the front bearing 21 is, and includes an outer race 28*a*, an inner race 28*b*, and balls 28*c*. The outer race 28*a* of the rear bearing 28 according to the exemplary embodiment is secured to the inner peripheral surface of the rear sleeve 26 by press-fitting or the like.

Referring to FIGS. 5A, 5B, and 6, the photoconductor PR (an exemplary rotary member) is provided between the front frame 12 and the rear frame 13. The photoconductor PR according to the exemplary embodiment includes a cylindrical photoconductor sleeve 31 (an exemplary rotary-member body). The surface of the photoconductor sleeve 31 is covered with a photoconductive layer. The photoconductor sleeve 31 is provided at the front and rear ends thereof with a front flange 32 (an exemplary front connecting portion) and a rear flange 33 (an exemplary rear connecting portion), respectively.

The front flange 32 according to the exemplary embodiment includes a disc-shaped front-flange body 32*a* (an exemplary front-connecting-portion body) that secures the front end of the photoconductor sleeve 31 at the outer periphery thereof. The front-flange body 32*a* is integrally provided at the inner periphery thereof with a front-flange cylindrical portion 32*b* (an exemplary first support-receiving portion) that extends in the anteroposterior direction. The inner periphery of the front-flange cylindrical portion 32*b* defines a through hole 32*c* that allows the small-diameter portion 1*b* of the drive shaft 1 to pass therethrough. The through hole 32*c* of the front flange 32 according to the exemplary embodiment is set such that the diameter thereof increases from the rear to the front, with the diameter at the rear end thereof being substantially the same as the outside diameter of the small-diameter portion 1*b*. Hence, when the drive shaft 1 is inserted into the through hole 32*c*, the drive shaft 1 comes into contact with the rear edge of the through hole 32*c*, whereby the front flange 32 is positioned relative to the drive shaft 1.

The front-flange cylindrical portion 32*b* supports at the front outer periphery thereof the inner race 21*b* of the front bearing 21. In the exemplary embodiment, the inner race 21*b* of the front bearing 21 is secured to the front flange 32 by press-fitting or the like. Hence, the front flange 32 according to the exemplary embodiment is supported in such a manner as to be movable relative to the front sleeve 16 in the anteroposterior direction, together with the front bearing 21 that is movable in the anteroposterior direction along the inner peripheral surface of the front sleeve 16.

The front-flange cylindrical portion 32*b* has at the rear end thereof a serration 32*d* (an exemplary rotation-receiving portion). The serration 32*d* includes a series of saw-tooth-like members surrounding a position of the drive shaft 1 at which the transmitting pin 2 is provided. Hence, when the process unit U2 is attached to the printer body U1 and the drive shaft 1 is inserted into the process unit U2, the transmitting pin 2 fits between some of the saw-tooth-like members of the serration 32*d*, producing a state where the rotation of the drive shaft 1 is ready to be transmitted to the front flange 32. Thus, the drive shaft 1 and the photoconductor PR are allowed to rotate together.

The rear flange 33 according to the exemplary embodiment includes a disc-shaped rear-flange body 33*a* (an exemplary rear-connecting-portion body) that secures at the outer periphery thereof the rear end of the photoconductor sleeve 31. The rear-flange body 33*a* is integrally provided at the inner periphery thereof with a rear-flange cylindrical portion 33*b* (an exemplary second support-receiving portion) that extends toward the rear. The rear-flange cylindrical portion 33*b* supports at the rear end thereof the inner race 28*b* of the rear bearing 28 such that the inner race 28*b* is movable in the anteroposterior direction. That is, the rear bearing 28 is supported in such a manner as to be slidable in the anteroposterior direction along the outer peripheral surface of the rear-flange cylindrical portion 33*b*.

The rear-flange cylindrical portion 33*b* includes front and rear portions, the front portion having a larger diameter than the rear portion. The rear end of the front portion of the rear-flange cylindrical portion 33*b* forms a rear stopper 33*c* (an exemplary second stopping portion). The rear stopper 33*c* is configured to come into contact with the inner race 28*b* of the rear bearing 28.

The rear-flange cylindrical portion 33*b* has at the rear end thereof a contact-receiving portion 33*d* configured to come into contact with the contact surface 3*a* of the tapered member 3. Hence, the inside diameter of the rear-flange cylindrical portion 33*b* according to the exemplary embodiment is set so as to be larger than the outside diameters of the large-diameter portion 1*a* of the drive shaft 1 and the front end of the tapered member 3 and to be smaller than the outside diameter of the rear end of the tapered member 3. Therefore, when the process unit U2 is attached to the printer body U1 and the drive shaft 1 is inserted into the process unit U2, the contact-receiving portion 33*d* comes into contact with and is pressed against the contact surface 3*a* of the tapered member 3. Thus, the rear flange 33 is positioned relative to the drive shaft 1.

(Operation According to Exemplary Embodiment)

In the printer U according to the exemplary embodiment configured as described above, when an image forming operation is started, the drive shaft 1 rotates. The rotation transmitted through the transmitting pin 2 and the serration 32*d* causes the photoconductor PR to rotate. Then, the formation of a latent image, the development of the latent image, the transfer of the developed image, and the fixing of the transferred image are sequentially performed. Thus, an image is formed on the sheet S.

In the use of the printer U, if, for example, any damage or wear of elements included in the process unit U2 occurs with time or any such elements fail, the front panel Ua is opened and the process unit U2 is replaced.

Referring to FIGS. 5A, 5B, and 6, the photoconductor PR according to the exemplary embodiment is supported by the unit frame 11 such that the front flange 32 and the rear flange 33 are rotatable with the aid of the front bearing 21 and the rear bearing 28, respectively. Thus, the photoconductor PR is positioned in the vertical and lateral directions while being movable in the anteroposterior direction.

Hence, in the state where the process unit U2 is in the printer body U1 as illustrated in FIGS. 5A and 5B, the drive shaft 1 extends through the front flange 32 and the rear flange 33; the tapered member 3 presses the contact-receiving portion 33*d* of the rear flange 33 toward the front; and the coil spring 19 urges the front flange 32 of the photoconductor PR toward the rear with the front bearing 21 interposed therebetween. The urging by the coil spring 19 causes the rear flange 33 to be pressed against the tapered member 3. Thus, the photoconductor PR is positioned in the anteroposterior direction.

In the state where the process unit U2 has been detached from the printer body U1 as illustrated in FIG. 6, the coil spring 19 urges the front bearing 21 toward the rear; and the outer race 21*a* of the front bearing 21 or the inner race 28*b* of the rear bearing 28 is in contact with the front stopper 16*a* or the rear stopper 33*c*. Thus, the photoconductor PR is positioned in the anteroposterior direction.

According to a related-art configuration disclosed in Japanese Unexamined Patent Application Publication No. 2001-117308 (Paragraphs [0011] to [0020] and FIGS. 2 and 4), in a state where a detachable unit such as a process unit has been detached from a unit-receiving apparatus such as a printer body, a rotary member such as a photoconductor included in the unit is movable in the lateral and vertical directions intersecting the axis of the rotary member. In such a configuration, while the detachable unit is handled for transportation or for attaching and detaching operations or the like, the rotary member may move, for example, be tilted, inside the unit and may come into contact with other elements provided near the rotary member, leading to damage or failure of the rotary member and the near elements.

In contrast, the process unit U2 according to the exemplary embodiment is configured as follows. The photoconductor PR is retained at the position illustrated in FIG. 6 in the axial direction thereof by the contact between the stopper 16*a* and the bearing 21 or between the stopper 33*c* and the bearing 28 and by the urging force of the coil spring 19, and is immovably retained in the direction intersecting the axial direction thereof by the flanges 32 and 33 supported by the respective bearings 21 and 28. Such a configuration suppresses the occurrence of damage and failure due to, for example, contact between elements included in the process unit U2 during the transportation or other operations of handling the process unit U2.

According to another related-art configuration disclosed in Japanese Unexamined Patent Application Publication No. 2000-162922 (Paragraphs [0038] to [0049] and FIGS. 2 and 3), the shaft of a rotary member needs to be fastened with screws after the detachable unit is attached. Hence, there are some problems such as increases in the number of components and in costs, and the necessity of additional tools and operations for fastening and relaxing the screws in attaching and detaching the unit, imposing cumbersome work.

In contrast, according to the exemplary embodiment, by simply inserting and withdrawing the process unit U2 into and from the printer body U1 in the axial direction of the photoconductor PR, the photoconductor PR is positioned appropriately, and the process unit U2 is attachable to and detachable from the printer body U1. That is, the process unit U2 according to the exemplary embodiment has a simple configuration. Accordingly, the increase in costs is suppressed, and the ease of handling is provided.

Furthermore, in the process unit U2 according to the exemplary embodiment, the front and rear sleeves 16 and 26 support the front and rear bearings 21 and 28, respectively, and the front and rear frames 12 and 13 extending in the direction intersecting the axial direction are provided at respective positions on the outer peripheries of the front and rear sleeves 16 and 26 corresponding to the positions of the bearings 21 and 28. That is, the outer peripheries of the bearings 21 and 28 supporting the front and rear ends, respectively, of the photoconductor PR are supported by the front and rear frames 12 and 13, respectively, extending in the radial direction, with the respective sleeves 16 and 26 interposed therebetween. In a case where the positions of the front and rear frames 12 and 13 do not correspond to the positions of the respective bearings 21 and 28, if any vibration or deformation, i.e., deflection, in a direction intersecting the axis of the photoconductor PR occurs with the rotation of the photoconductor PR, the sleeves 16 and 26 may also bend with the deflection. In contrast, according to the exemplary embodiment, the front and rear frames 12 and 13 are provided at the back of the respective bearings 21 and 28 with the respective sleeves 16 and 26 interposed therebetween. Therefore, the rotation of the photoconductor PR is more stabilized.

(Modifications)

While an exemplary embodiment of the present invention has been described above in detail, the invention is not limited thereto, and various modifications may be made thereto within the scope of the invention defined in the appended claims. Modifications H01 to H05 of the exemplary embodiment of the invention will now be described.

(Modification H01) While the above exemplary embodiment concerns the printer U (an exemplary image forming apparatus), the invention is not limited thereto and is also applicable to any of other apparatuses such as a copier, a facsimile, and a multifunctional machine having multiple functions of the foregoing apparatuses. Moreover, while the above exemplary embodiment concerns a monochrome image forming apparatus, the invention is not limited thereto and is also applicable to a color image forming apparatus.

(Modification H02) While the above exemplary embodiment concerns the process unit U2 (an exemplary detachable unit), the invention is not limited thereto and is also applicable to any of other detachable units including rotary members: for example, a toner cartridge, a collecting box into which the developer collected by a cleaner or the like is collected, and a developing unit.

(Modification H03) While the above exemplary embodiment concerns a configuration in which the outer race 21*a* is slidable in the front bearing 21 and the inner race 28*b* is slidable in the rear bearing 28, the invention is not limited thereto, and any other combination of slidable races may be employed.

(Modification H04) While the above exemplary embodiment employs the stoppers 16*a* and 33*c*, only one of the stoppers 16*a* and 33*c* may be provided.

(Modification H05) While the above exemplary embodiment concerns a configuration in which the coil spring 19 is provided on the front side, the invention is not limited thereto, and the coil spring 19 may be provided on the rear side.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A detachable unit configured to be attached to a unit-receiving apparatus, the detachable unit comprising:

a unit body;

a rotary member supported by the unit body and having a through hole configured to receive a rotary shaft, the through hole extending in an attaching and detaching direction in which the detachable unit is attached to and detached from the unit-receiving apparatus;

an urging member urging the rotary member toward a downstream side in an attaching direction in which the detachable unit is attached to the unit-receiving apparatus;

a contact-receiving portion provided at a position of the rotary member on the downstream side in the attaching direction and being configured to be pressed against a contact portion provided on the rotary shaft toward an upstream side in the attaching direction when the detachable unit is attached to the unit-receiving apparatus;

a first support-receiving portion provided at one end of the rotary member;

a second support-receiving portion provided at the other end of the rotary member;

a first support provided at a position of the unit body corresponding to the position of the first support-receiving portion;

a second support provided at a position of the unit body corresponding to the position of the second support-receiving portion;

a first rotary support member provided between the first support-receiving portion and the first support and supporting the one end of the rotary member such that the rotary member is rotatable, the first rotary support member being supported in such a manner as to be movable in the attaching and detaching direction relative to at least one of the first support-receiving portion and the first support; and a second rotary support member provided between the second support-receiving portion and the second support and supporting the other end of the rotary member such that the rotary member is rotatable, the second rotary support member being supported in such a manner as to be movable in the attaching and detaching direction relative to at least one of the second support-receiving portion and the second support, wherein the rotary member is rotatably supported by the unit body when the rotary shaft is not present.

2. An image forming apparatus comprising:

an image-forming-apparatus body including a unit-housing portion, a rotary shaft provided in the unit-housing portion, and a contact portion provided on the rotary shaft; and a detachable unit housed in the unit-housing portion and adapted to be detachable from the image-forming apparatus, the detachable unit including a unit body, a rotary member supported by the unit body and to which rotation of the rotary shaft is transmitted in a state where the rotary shaft has been inserted into the rotary member, the rotary shaft extending in an attaching and detaching direction in which the detachable unit is attached to and detached from the image-forming-apparatus body, an urging member urging the rotary member toward a downstream side in an attaching direction in which the detachable unit is attached to the image-forming-apparatus body, a contact-receiving portion provided at a position of the rotary member on the downstream side in the attaching direction and being configured to be pressed against a contact portion toward an upstream side in the attaching direction when the detachable unit is attached to the image-forming-apparatus body, a first support-receiving portion provided at one end of the rotary member, a second support-receiving portion provided at the other end of the rotary member, a first support provided at a position of the unit body corresponding to the position of the first support-receiving portion, a second support provided at a position of the unit body corresponding to the position of the second support-receiving portion, a first rotary support member provided between the first support-receiving portion and the first support and supporting the one end of the rotary member such that the rotary member is rotatable, the first rotary support member being supported in such a manner as to be movable in the attaching and detaching direction relative to at least one of the first support-receiving portion and the first support, and a second rotary support member provided between the second support-receiving portion and the second support and supporting the other end of the rotary member such that the rotary member is rotatable, the second rotary support member being supported in such a manner as to be movable in the attaching and detaching direction relative to at least one of the second support-receiving portion and the second support, wherein the rotary member is configured to be rotatably supported by the unit body when the rotary shaft is not present.

3. The detachable unit according to claim 1, wherein the first support-receiving portion and the second support-receiving portion each have a through hole configured to receive the rotary shaft.

4. The image forming apparatus according to claim 2, wherein the first support-receiving portion and the second support-receiving portion each have a through hole configured to receive the rotary shaft.

5. The detachable unit according to claim 1, wherein the first rotary support contacts the first support-receiving portion and the second rotary support contacts the second support-receiving portion.

6. The image forming apparatus according to claim 2, wherein the first rotary support contacts the first support-receiving portion and the second rotary support contacts the second support-receiving portion.

* * * * *